US005707163A

United States Patent [19]

Gregory

[11] Patent Number: 5,707,163

[45] Date of Patent: Jan. 13, 1998

[54] PORTABLE STAIN AND SPOT REMOVAL SYSTEM

[76] Inventor: Jack Gregory, 100 Reed Blvd. , Apt. 2., Mill Valley, Calif. 94941

[21] Appl. No.: 345,499

[22] Filed: Nov. 28, 1994

[51] Int. Cl.[6] ..... A46B 11/02

[52] U.S. Cl. ..... 401/10; 401/183; 401/268; 68/213

[58] Field of Search ..... 401/9, 10, 11, 401/183, 268; 15/21.2, 21.1, 29; 68/213, 214, 240

[56] References Cited

U.S. PATENT DOCUMENTS

| | | | |
|---|---|---|---|
| 656,802 | 8/1900 | Batz | 68/213 |
| 2,552,853 | 5/1951 | Isserstedt | 68/213 |
| 2,643,406 | 6/1953 | Cunningham | 15/29 |
| 2,743,470 | 5/1956 | Horowitz | 401/10 |
| 2,975,448 | 3/1961 | Glaser | 68/240 X |
| 3,044,089 | 7/1962 | Boxton | 15/21.2 |
| 3,564,636 | 2/1971 | Tomer | 401/10 X |
| 4,350,457 | 9/1982 | Carnahan | 401/11 |
| 4,899,413 | 2/1990 | Trobiani | 15/21.2 |

FOREIGN PATENT DOCUMENTS

| | | | |
|---|---|---|---|
| 636048 | 12/1978 | Russian Federation | 15/21.2 |

*Primary Examiner*—Steven A. Bratlie
*Attorney, Agent, or Firm*—Curtis L. Harrington

[57] ABSTRACT

A stain removal device and process sets forth a device and method which facilitates the removal of stains by employing a number of mutually beneficial structures and processes. A limited area of material is exposed to both the soap or other removal solution by encasing the limited area of material onto a washboard top surrounded by an "o" ring forming the lower portion of a sealing cap. The upper portion of the sealing cap has downward projections which both accommodate and grasp the surrounding material, but which also engage the lower portion of the sealing cap. The upper portion accommodates a downwardly directed and rotatable brush which is brought to bear on the stained area of material when the upper portion is engaged onto the lower portion of the sealing cap. The brush is rotatable to scrub the stained area of material, and has a central bore in fluid communication with the brush bristles. Once the area has been adequately scrubbed, water may be forced from a squeeze bottle onto which the lower portion of the sealing cap is mounted, through apertures in the scrub-board surface of the lower portion of the sealing cap, through the stained material, through the axial center of the brush assembly and out of the upper opening of the brush assembly.

8 Claims, 3 Drawing Sheets

PORTABLE STAIN AND SPOT REMOVAL SYSTEM

FIELD OF THE INVENTION

The present invention relates to the field of devices used to enhance and preserve clothing, and more particularly to a system for quick, efficient treatment of a spot or stain in clothing.

BACKGROUND OF THE INVENTION

Clothing stains can be one of the most exasperating aspects of attempts to dress well and meticulously. It seems that as finer clothing are worn, their ability to attract stains increases. Of course, the entire unit of clothing can always be turned in to the dry cleaners to have it laundered, but there is not always time to accomplish this shot gun approach to stains.

Dry spot removers in spray can form are available, but often do not remove the stain, and can in some circumstances discolor the material depending upon the propensity of the solvent to dissolve the clothing dye.

Water is always the best solvent for use with a spot or stain, along with a soap or other chemical such as woolite or a more concentrated soap. This is especially true since water will act to remove the water soluble soap or other treatment solution, and a remaining spot of soap or other treatment material may be more noticeable than the original stain.

However, washing a whole garment in water is a disaster, particularly for wool and other delicate fabrics. Water can cause them to become misshapen and to shrink. However, water can be applied to a limited area of the fabric. The problem is one of control. Usually, and especially if the fabric is thick, the water will move through the fabric slowly. If the stain is held under a tap, the water stream will be more rapidly soaked up by the surrounding fabric than it will go through the fabric.

Even where sparing amounts of water are used, with the corresponding reduction in water going to the surrounding material, the fabric will usually have to be crushed and twisted to get the soap or other treatment chemical deep enough to do an adequate Job on the stain. One of the reasons for this is that there may not be a brush present. When a brush is present, its side to side action will invariably help to spread the water and soap solution further onto the adjacent fabric.

What is therefore needed is a system which isolates the cleaning solvent, preferably water onto a limited portion of the fabric whose stain is to be removed, facilitates brushing and cleaning of the fabric onto the limited portion of the fabric whose stain is to be removed, and which can use a relatively large volume of water to remove the stain and soap solution, not onto the adjacent areas of surrounding fabric, but rather onto the limited portion of the fabric whose stain is to be removed.

SUMMARY OF THE INVENTION

The stain removal device and process of the present invention sets forth a device and method which facilitates the removal of stains by employing a number of mutually beneficial structures and processes. A limited area of material is exposed to both the soap or other removal solution by encasing the limited area of material onto a washboard top surrounded by an "o" ring forming the lower portion of a sealing cap. The upper portion of the sealing cap has downward projections which both accommodate and grasp the surrounding material, but which also engage the lower portion of the sealing cap. The upper portion accommodates a downwardly directed and rotatable brush which is brought to bear on the stained area of material when the upper portion is engaged onto the lower portion of the sealing cap. The brush is rotatable to scrub the stained area of material, and has a central bore in fluid communication with the brush bristles.

Once the area has been adequately scrubbed, water may be forced from a squeeze bottle onto which the lower portion of the sealing cap is mounted, through apertures in the scrub-board surface of the lower portion of the sealing cap, through the stained material, through the axial center of the brush assembly and out of the upper opening of the brush assembly. In this manner, a relatively large volume of water is employed to rinse a relatively small area of fabric which has been scrubbed with the brush of the upper portion of the sealing cap.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
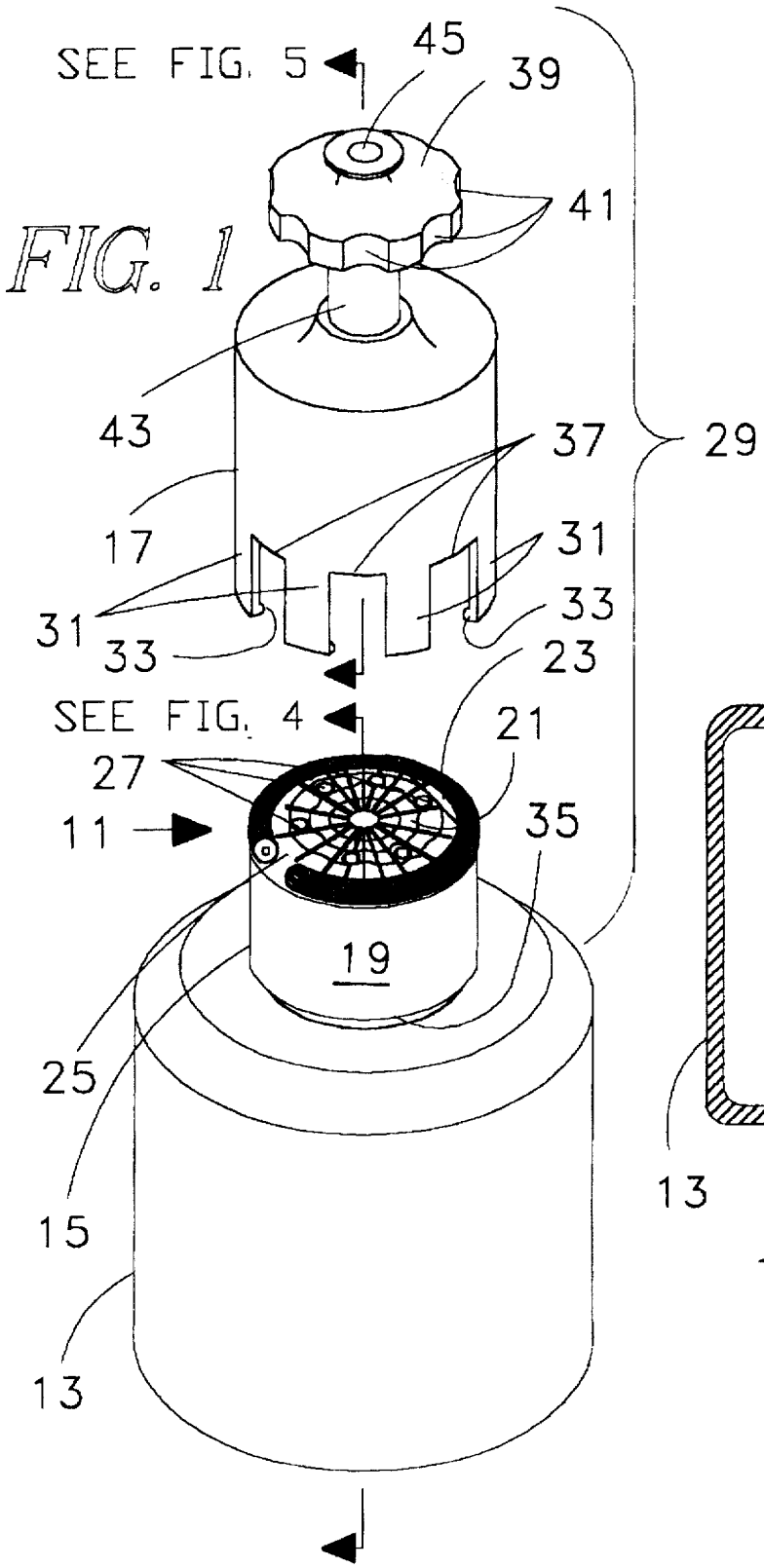
FIG. 1 is a perspective view the spot removal system of the present invention shown with an upper portion of the sealing cap displaced above a lower portion of the sealing cap and illustrating the scrub board surface.

The description and operation of the invention will be best described with reference to FIG. 1. FIG. 1 is a perspective view of the spot removal system 11 of the present invention, having a squeeze bottle 13, a cap lower portion 15, and a cap upper portion 17. The squeeze bottle 13 can be of any type, but is preferably made of strong plastic which will re-urge itself to the un-squeezed position after each time that it is squeezed.

The squeeze bottle 13 will typically have a threaded neck, not shown in FIG. 1, and the threads and neck diameter will preferably be of a standard size. The lower portion 15 has a side surface 19 and an upper scrub board surface 21. The upper scrub board surface 21 may be formed as a series of radial depressions across a series of concentric circular depressions. The areas bound by the radial and circular depressions may also include some vertical height differentiation to provide a rougher scrub board surface 21. Surrounding the scrub board surface 21 is an "o" ring 23. Preferably the "o" ring will fit into a groove 25 surrounding the lower portion 15.

The scrub board surface 21 has a series of apertures 27 which will be in fluid communication with the inside of squeeze bottle 13 when the lower portion 15 is screwably attached onto the squeeze bottle 13. The apertures 27 will not only enable the bulk of the volume of water which will be held within squeeze bottle 13 to flow past the upper scrub board surface 21, but will allow the spotted area of material to be initially wetted by simply tilting the squeeze bottle 13 over for a moment.

The size and mounting of the "o" ring 23 is such that it will extend upwardly and outwardly to make sure that sealing engagement will be had. The upper portion 17, together with the lower portion 15 form a sealing cap 29. The upper portion 17 contains a series of downwardly directed finger projections 31, each of which may have an inward lip 33 for grasping the under edge 35 of the lower portion 15. The finger projections 31 define interstitial spaces 37 which will accommodate adjacent areas of material. This is necessary since for a given area of material, the adjacent areas will bunch together, and such interstitial spaces 37 will enable the bunches of material to extend from the upper portion 17.

The upper portion 17 also has a handle 39 defining a series of finger grooves 41 to facilitate the turning of the handle 39. The handle 39 is attached to a rotatably mounted conduit 43 which is attached to handle 39 and which terminates above handle 39 as the open end 45 of the conduit 43. Thus, the upper portion 17 can grasp onto and seal with respect to the lower portion 15 using the finger projections 31 and particularly the inward lips 33 of the finger projections 31 engaging the under edge 35 of the lower portion 15.

Figure 2:
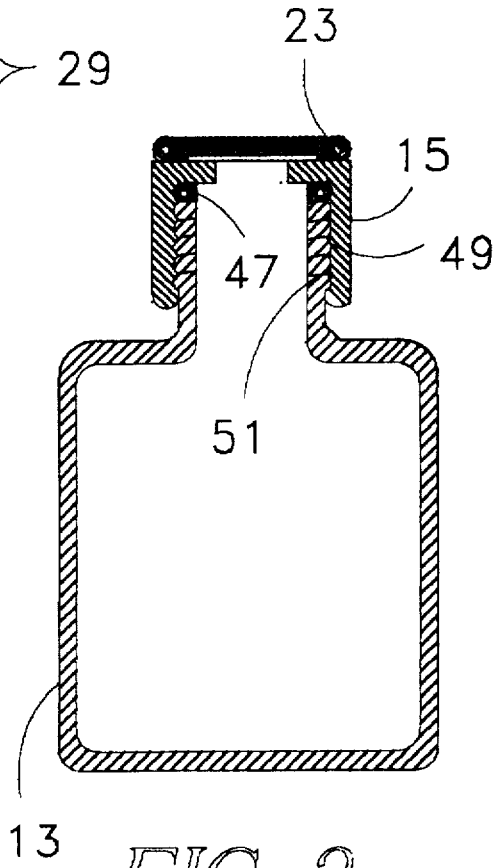
FIG. 2 is a sectional view of the squeeze bottle and lower portion of the sealing cap and illustrating the engagement thereof.

Referring to FIG. 2, cross sectional view of the squeeze bottle 13 and lower portion 15 is shown. Most prominent is the area of threaded engagement between the lower portion 15 and the squeeze bottle 13. Shown is an optional second "o" ring 47 which may interfit between the upper surface of the neck of the squeeze bottle 13 and the lower surface of the upper inside portion of the lower portion 15 of the sealing cap 29. This second "o" ring can be eliminated where the lower portion 15 and the upper neck of the squeeze bottle 13 have Other sealing members, or are formed precisely enough to act as their own sealing members.

As can be seen, the squeeze bottle 13 supports a series of outwardly disposed threads 49 which engage an inwardly disposed threaded surface 51 of the lower portion 15.

Figure 3:
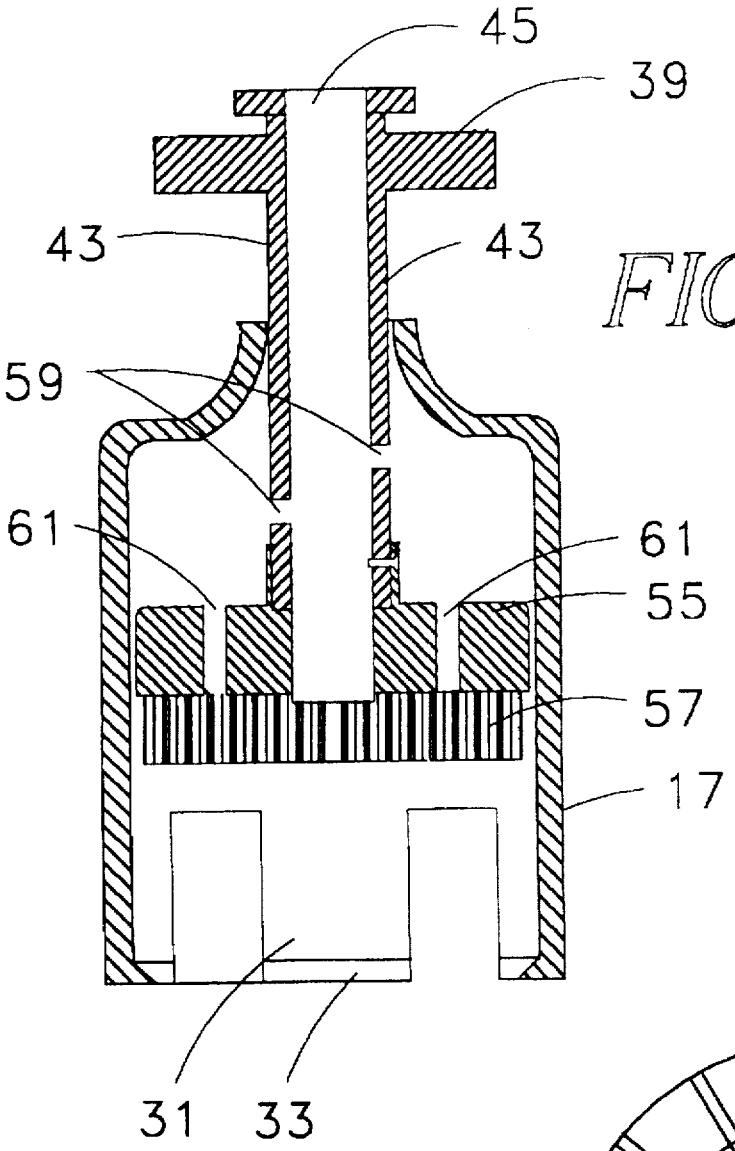
FIG. 3 is a sectional view of the upper portion of the sealing cap and illustrating the handle and its attached brush, as well as apertures for facilitating fluid flow from within the upper portion and through the upper open end.

Referring to FIG. 3, a cross sectional view of the upper portion 17 is shown. As is seen, the rotatably mounted conduit 43 supports a brush 55 from the back surface of brush 55. Brush 55 supports a series of downwardly oriented bristles 57 from its bristle surface. Since the rotatably mounted conduit 43 may rotate about the axis of its length, the brush 55 will rotate with the conduit 43. The section of conduit 43 immediately above the brush 55 may have one or more conduit apertures 59 and or one or more brush apertures 61. Other structures may be available for wash water to flow from the inside of the upper portion 17 into and out of the open end 45 of the rotatably mounted conduit 43. Water may also be able to flow around the brush 55 in between the edges of the brush 55 and the inside of the upper portion 17.

Figure 4:
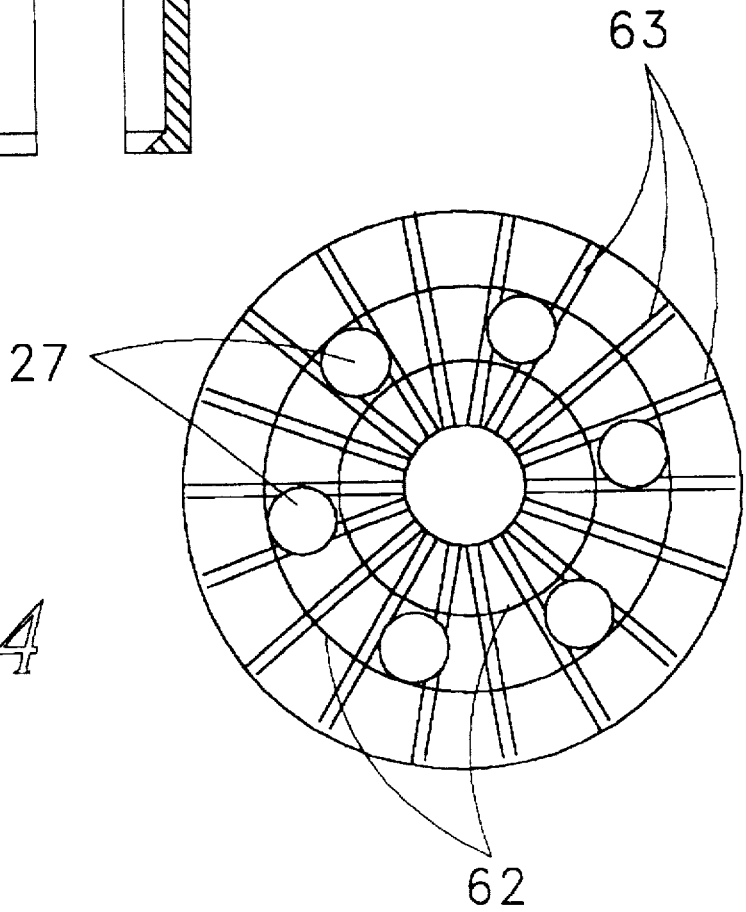
FIG. 4 is an expanded view of the scrub board surface shown in FIG. 1.

Referring to FIG. 4, a downward view of the upper scrub board surface 21 gives a close-up view of the structures, including apertures 27. Also shown are a series of concentric grooves 62 and a series of radial grooves 63 which help form the washboard or upper scrub board 21 surface.

Figure 5:
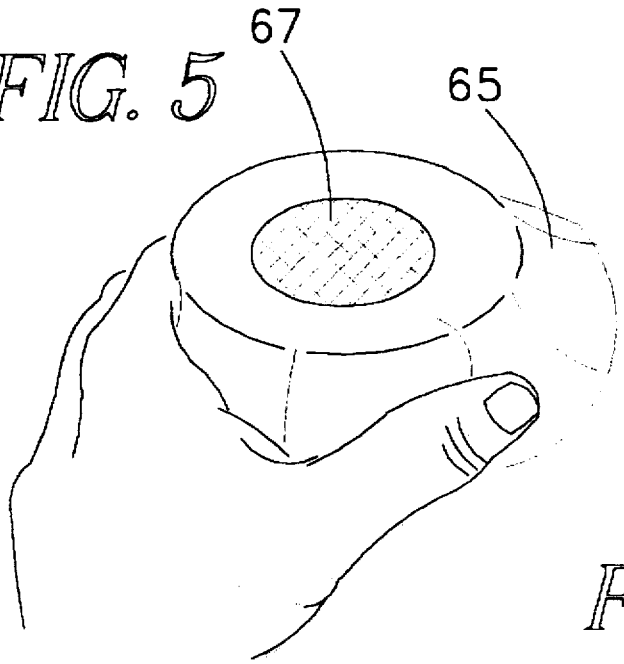
FIG. 5 is a view of stained material being set upon the lower portion of the sealing cap by hand in preparation for the application of soap or spot removal material.

Referring to FIG. 5, the use of the spot removal system 11 of the present invention is shown. A length of material 65 having a spot 67 is positioned atop the cap lower portion 15 with the spot 67 centered on the lower portion 15 as best as possible. Next, a small amount of concentrated soap or stain removing material is gently rubbed into the spot 67, manually or with an applicator(not shown). It should be insured that there will be enough of the soap or remover sufficient to adequately cover and infiltrate the spot 67.

Figure 6:
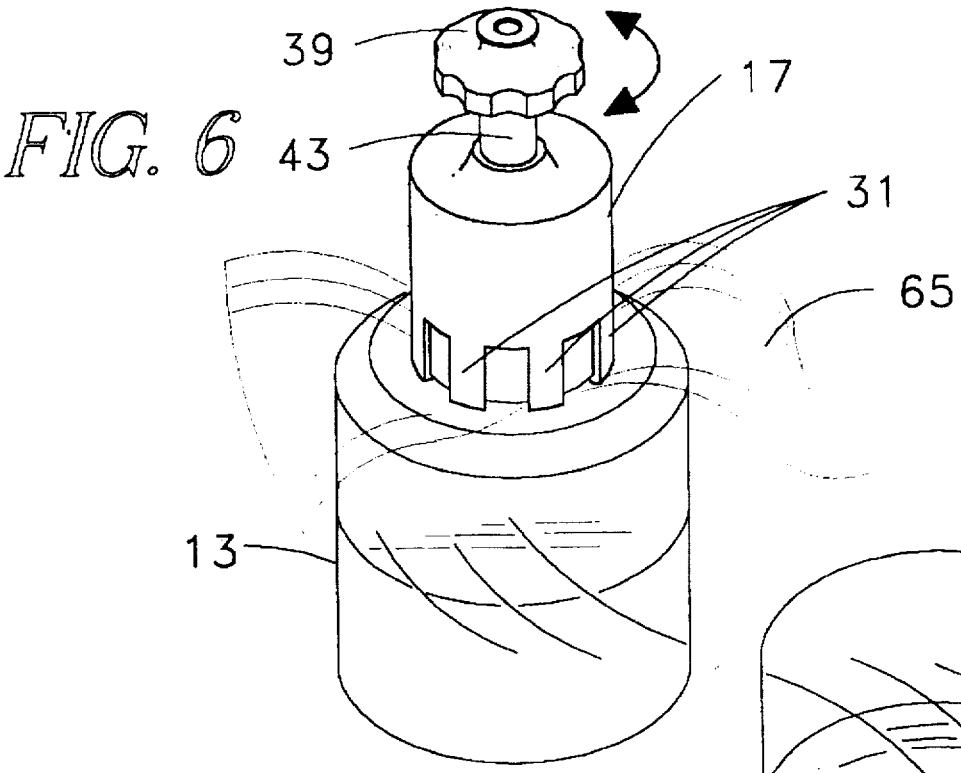
FIG. 6 is a perspective view of the upper portion engaged with respect to the lower portion of the sealing cap and engaging the stained material therebetween, and illustrating the action of the upper handle.

Next, the upper portion 17 is placed atop the material 65 and spot 67 as is shown in FIG. 6. If possible, the finger projections 31 and their inward lip 33 should be able to engage the under edge 35 of the lower cap portion 15. The interstitial spaces 37 should help accommodate the folds in the material 65 to enable the finger projections 31 to make adequate contact with the under edge 35. Where thicker material 65 is present, the inward lips 33 may not be able to engage the under edge 35, which still may be acceptable. In such an event, manual pressure may have to be continued upon the upper portion 17 to press down upon lower portion 15 to keep it in place with respect to the lower portion 15.

Next, the sealing cap 29 and squeeze bottle 13 may be inverted to allow a limited amount of water to flow through the series of apertures 27 in the scrub board surface 21 and onto the portion of the material 65 containing the stain 67. Because of the "o" ring 23 and its bearing against the material 65, water is substantially inhibited from freely expanding beyond the immediate area bound by the "o" ring 23. Of course, the water may spread in proportion to the thickness of material present and the wicking opportunity it presents, but the close fit and "o" ring 23 will at least inhibit this action.

As is shown in FIG. 6, a double headed arrow illustrates the rotatability of handle 39 which, in turn, rotates the brush 55 and its bristles 57 against the upper surface of the material 65. Preferably, the material will be oriented with the spot on the upper surface of the material with respect to FIG. 5, or oriented toward the bristles 57.

Further, the vertical clearance between the upper portion 17 and lower portion 15 may be such that the brush 55 and its bristles 57 clearance with respect to the scrub board surface 21 that the bristles 57 bear with some compression against the material 65. Where such bearing is significantly compressive, the turning resistance of the handle 39 will be high, as will be the efficiency of scrub obtained with each turn of the handle 39. It is recommended that the handle be turned first one way and then the next to obtain a good scrub. This process may proceed for several minutes to insure that the spot or stain 67 has been adequately scrubbed.

Figure 7:
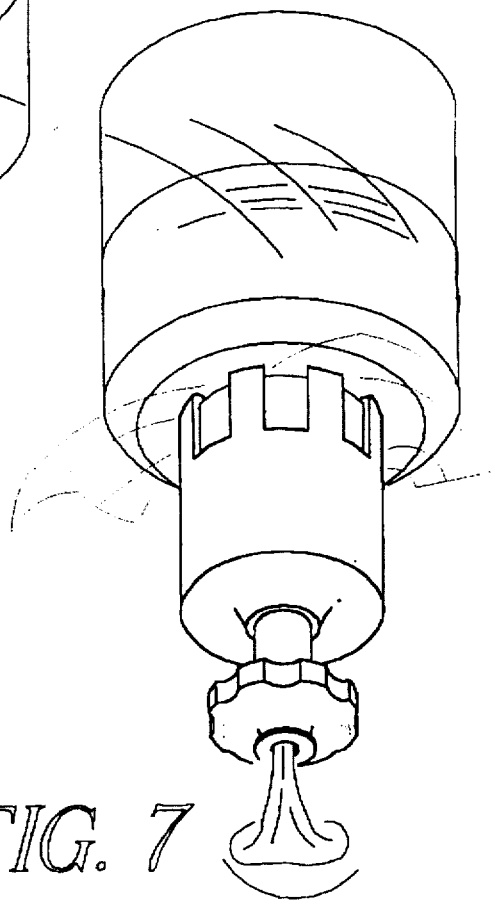
FIG. 7 is a perspective view of the upper portion of the spot removal assembly of FIG. 6 in a tilted position and illustrating the elimination and washing of the material by forcing water through the material 65 and out of the open end of the upper most end of the upper portion of the sealing cap.

Once an adequate amount of scrubbing has occurred, the bottle is tilted downwardly, and the squeeze bottle 13 portion manually compressed. The pressure sends a stream of water through the series of apertures 27, portion of material 65 bound by the "o" ring 23, washing away stain 67 material, soap, and all soluble matter present. The stream may travel through the conduit apertures 59 and or brush apertures 61 if present, and then into and out of the rotatably mounted conduit 43, as is shown in FIG. 7.

Once the water in the squeeze bottle 13 has been forced through the rotatably mounted conduit 43 and released, a back suction will occur, provided the squeeze bottle 13 is sufficiently strong to enable such action. The forcing of air back through the series of apertures 27 on the scrub board surface 21, particularly with the presence of the concentric grooves 62 and the radial grooves 63 acting as drainage channels, begins to dry the area of material 65 bound by the "o" ring 23. Thus, the spot removal system 11 of the present invention, with its last bit of processing actually begins to help to dry the material 65.

One of the major actions of the present invention is the provision of a relatively large amount of water, provided according to the size of the squeeze bottle 13, and which is provided to the relatively small surface area of the material 65 within the "o" ring 23. This washing equivalent is much like having a washing machine rinse with 30 to 50 times the volume of water used for washing. The stain 67, assuming that there is adequate soap or stain removal material to make the stain soluble, will not fail to be removed for lack of sufficient rinse water.

Further, the rinse water is supplied as a continuous stream. This is mathematically more efficient than using the same volume of water, sub-divided into smaller portions, and brought into contact with the stain 67 on a batch basis. This factor makes a relative volume of 30 to 50 rise to a factor of from about 40 to 80.

The steps outlined above can be repeated where the stain is stubborn, and the soap or stain removal material can be escalated in strength where an initial scrubbing fails to remove the stain.

Due to the efficiency available with relatively small amounts of fluid, there exists the possibility to use a non-water based fluid. Not only will the potential area of migration be limited, but the fluid which may also be a hazardous waste is conserved. Thus, where the stain is an indelible ink stain, or an oil based paint stain, mineral spirits or other organic solvent may be used. Where the stain is small enough, the organic solvent may be simply poured back into the container, especially where the stain is of limited mass, or where the requirement for the organic fluid is not such that ultra-high purity is required.

It is understood that the system 11 has been thus far described in terms of a completely portable structure mounted atop a squeeze bottle 13. The system 11 may be available without the squeeze bottle 13, particularly where the internal threaded surface 51 is of a standard size so as to interfit with many types of available squeeze bottles 13.

It is also understood that the use of finger projections 33 are but one way to accommodate areas of material 65 which are, adjacent to the stain 67. The upper portion 17 may be articulatable with regard to the lower portion 15, about a pivot point displaced from the two, to form a space which will accommodate material which is adjacent to the area being enclosed within the "o" ring 23. Regardless of the manner of articulation, or the structures involved in associating the upper and lower portions 17 and 15, the central idea is that these structures form an isolation chamber within which an area of material 65 is isolated during the brushing or scrubbing action. This isolation permits the area to create suds which will not pass to the outside of the sealing cap 29 of the present invention. By isolating not only the portion of the material 65 having the stain 67, but also the material applied to dissolve the stain, such as a soap, the material remains concentrated on the stain, and enhances the action of the spot removal system of the present invention.

Further, the use of a squeeze bottle 13 as a water supply may be circumvented where a water inlet tap accommodation is made. This may be an inlet connection which fits onto the end of a sink tap, and which uses the water pressure to force the water through the portion of material bound by the "o" ring 23.

While the present invention has been described in terms of a spot removal system, one skilled in the art will realize that the structure and techniques of the present invention can be applied to many appliances. The present invention may be applied in any situation where a wetted area is sought to be limited, and water or other liquid is to be forced through a relatively small area, and where the liquid is sought to be conserved.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A stain removal structure comprising:

a lower portion having a first end adapted for attachment to a squeeze bottle and a second end having at least one fluid aperture and a scrub board surface;

an upper portion positionable with respect to said lower portion, and having at least one fluid aperture extending therethrough, for the exit of fluid; and a rotatable brush carried within said upper portion and opposing said scrub board surface of said lower portion, whereby fluid may be introduced onto said scrub board surface for scrubbing by said rotatable brush and whereby squeezing of the squeeze bottle forces the fluid introduced, as well as fresh fluid through the scrub board surface and out through said at least one fluid aperture.

2. The stain removal structure recited in claim 1 and further comprising a squeeze bottle, connected to said lower portion and in fluid contact with said aperture of said lower portion.

3. The stain removal structure recited in claim 1 and further comprising:

a conduit rotatably mounted with respect to said upper portion and having a first open end outside said upper portion and a second end within said upper portion and to which said brush is affixed; and a handle, surrounding said conduit and mounted nearer said first end of said conduit, for providing manual assistance in turning said conduit.

4. The stain removal structure recited in claim 3 wherein said conduit defines at least one conduit aperture along a section of its length within said upper portion to enable fluid to pass from within said upper portion and through said conduit.

5. The stain removal structure recited in claim 4 wherein said brush has an back surface and a bristle surface and wherein said brush defines at least one brush aperture extending from said back surface to said bristle surface.

6. The stain removal structure recited in claim 1 wherein upper portion further defines a plurality of finger projections extending downwardly from said upper portion to guidably engage said lower portion.

7. The stain removal structure of claim 6 wherein each of said finger projections define an inward lip and wherein said lower portion has an under edge, and wherein said inward lip of said finger projection is sized to engage said under edge of said lower portion.

8. The stain removal structure system of claim 7 wherein said finger projections are separated by interstitial spaces at least as wide as said finger portions.

* * * * *